US009984813B2

(12) United States Patent
Hirata et al.

(10) Patent No.: US 9,984,813 B2
(45) Date of Patent: May 29, 2018

(54) REACTOR AND MANUFACTURING METHOD OF REACTOR

(71) Applicants: Shuichi Hirata, Nisshin (JP); Takeshi Okada, Aichi-ken (JP); Yoshikazu Kamikawa, Okazaki (JP)

(72) Inventors: Shuichi Hirata, Nisshin (JP); Takeshi Okada, Aichi-ken (JP); Yoshikazu Kamikawa, Okazaki (JP)

(73) Assignees: TOYOTA JIDOSHA KABUSHIKI KAISHA, Toyota-Shi, Aichi-ken (JP); TOKAI KOGYO CO., LTD., Obu (JP)

( * ) Notice: Subject to any disclaimer, the term of this patent is extended or adjusted under 35 U.S.C. 154(b) by 93 days.

(21) Appl. No.: 14/890,275

(22) PCT Filed: May 6, 2014

(86) PCT No.: PCT/IB2014/000685

§ 371 (c)(1),
(2) Date: Nov. 10, 2015

(87) PCT Pub. No.: WO2014/181165

PCT Pub. Date: Nov. 13, 2014

(65) Prior Publication Data

US 2016/0118185 A1 Apr. 28, 2016

(30) Foreign Application Priority Data

May 10, 2013 (JP) ..... 2013-100218

(51) Int. Cl.
*H01F 27/30* (2006.01)
*H01F 27/32* (2006.01)
(Continued)

(52) U.S. Cl.
CPC ..... *H01F 27/325* (2013.01); *H01F 27/2876* (2013.01); *H01F 27/327* (2013.01);
(Continued)

(58) Field of Classification Search
CPC ..... H01F 27/325; H01F 27/022; H01F 27/29; H01F 41/127
(Continued)

(56) References Cited

U.S. PATENT DOCUMENTS 3,434,079 A * 3/1969 Ege, Jr. ..... H01H 51/281 335/151
3,496,502 A * 2/1970 Moore ..... H01F 27/022 336/229
(Continued)

FOREIGN PATENT DOCUMENTS

JP 05-066950 U 9/1993
JP 2008-098209 A 4/2008
(Continued)

*Primary Examiner* — Alexander Talpalatski
*Assistant Examiner* — Joselito Baisa
(74) *Attorney, Agent, or Firm* — Sughrue Mion, PLLC

(57) ABSTRACT

A reactor (2) includes a bobbin (10). The bobbin is a resin-made bobbin, and has a pair of flanges (12*a*, 12*b*) that face each other. Coils (3) are wound around the bobbin between the pair of flanges. Each of a pair of plates (20) is bridged from the flange on one side, which is one of the pair of flanges, to the flange on the other side, which is one of the pair of flanges. The pair of plates abuts on circumferences of the coils between the pair of flanges. A resin cover (40) covers one of two outer peripheries of the coils. The two outer peripheries are defined by the pair of plates.

5 Claims, 5 Drawing Sheets

(51) Int. Cl.
*H01F 37/00* (2006.01)
*H01F 41/12* (2006.01)
*H01F 27/28* (2006.01)
*H01F 41/02* (2006.01)

(52) U.S. Cl.
CPC ..... *H01F 37/00* (2013.01); *H01F 41/02* (2013.01); *H01F 41/127* (2013.01)

(58) Field of Classification Search
USPC ..... 336/196, 198, 185
See application file for complete search history.

(56) References Cited

U.S. PATENT DOCUMENTS 3,750,073 A * 7/1973 Okano ..... H01F 5/02 242/118.41
3,939,450 A * 2/1976 Donnelly ..... H01F 5/04 336/192
4,177,439 A * 12/1979 Smith ..... H01H 51/281 29/602.1
4,216,455 A * 8/1980 Hester ..... H01F 27/2823 336/160
4,363,014 A * 12/1982 Leach ..... H01F 5/04 174/138 F
4,812,798 A * 3/1989 Chappel ..... H01F 27/325 219/760
5,223,811 A * 6/1993 Hendel ..... H01H 50/023 335/202
5,440,286 A * 8/1995 Pikul ..... H01F 27/324 336/160
5,534,839 A * 7/1996 MacKin ..... H01F 5/02 336/192
5,870,011 A * 2/1999 Mori ..... H01F 17/04 336/196
7,812,541 B2 * 10/2010 Lee ..... G02F 1/133604 315/85
8,054,152 B2 * 11/2011 Tseng ..... H01F 38/08 336/192
2011/0037554 A1 * 2/2011 Tsai ..... H01F 27/06 336/196

FOREIGN PATENT DOCUMENTS

JP 2009-246222 A 10/2009
JP 2010-147106 A 7/2010
JP 2011-249427 A 12/2011

* cited by examiner

REACTOR AND MANUFACTURING METHOD OF REACTOR

BACKGROUND OF THE INVENTION

1. Field of the Invention

The invention relates to a reactor and a manufacturing method of the reactor. The reactor is a passive element using a coil, and is also referred to as an "inductor".

2. Description of Related Art

A reactor includes a magnetic core, and a coil wound around the core. There is a type of a reactor that includes a bobbin between a coil and a core. In many cases, a reactor is often covered by a resin for the purpose of insulation and protection from physical contact with other devices (for example, Japanese Utility Model Application Publication No. 5-066950 (JP 5-066950 U), Japanese Patent Application Publication No. 2011-249427 (JP 2011-249427 A), Japanese Patent Application Publication No. 2009-24222 (JP 2009-246222 A)).

In a motor drive system of an electric vehicle including a hybrid vehicle, a reactor is sometimes used for a circuit of a voltage converter and so on. Since large current flows through a reactor for an electric vehicle, a calorific value is large. JP 5-066950 U discloses a reactor in which a coil is entirely covered by a resin. When the coil is entirely covered by a resin as stated above, it is difficult to dissipate heat from a coil if a calorific value is high. Therefore, a technology is proposed, in which a part of a coil is exposed in a resin cover and the exposed part promotes heat dissipation from the coil (for example, JP 2011-249427 A, and JP 2009-246222 A).

In the technology described in JP 2011-249427 A, one surface of a metallic block with high thermal conductivity abuts on a part where a coil is exposed. Also, the other surface of the metallic block abuts on a housing. By doing so, heat of the coil is diffused to the housing through the metallic block. In the technology described in JP 2009-246222 A, about a half of a coil is covered by a resin, and the other half is exposed. Air is sent to the exposed part to cool the coil.

SUMMARY OF THE INVENTION

As described as examples in JP 2011-249427 A and JP 2009-246222 A, in order to achieve both protection and cooling of a coil, it is preferable to cover a part of the coil by a resin and expose the remaining part. Herein below, a resin part that covers a coil is referred to as a resin cover for explanation. The resin cover is often made by an injection molding method in order to protect a coil and maintain a shape of the coil. To be specific, an assembly of a coil and a core is put in a die, and a molten resin is injected. The die is made of metal. The coil is made by winding a winding wire. Since the coil is made by winding a winding wire, accuracy of an outer shape of the coil is not high. Therefore, it is likely that a gap is made between the metallic die and the coil. Once a gap is made in a contact region between the die and the coil, a molten resin leaks out, it is likely that an area of a part of the coil, which is supposed to be exposed, is reduced.

The invention provides a reactor that exposes a part of a coil from a resin cover so as to ensure an exposed region of the coil appropriately, and a manufacturing method of the reactor.

According to a first aspect of the invention, a reactor includes a resin-made bobbin, a coil, a pair of plates, and a resin cover. The resin-made bobbin has a pair of flanges that face each other. The coil is wound around the bobbin between the pair of flanges. Each of the pair of plates is bridged between the flange on one side, which is one of the pair of flanges, to the flange on the other side, which is one of the pair of flanges. The pair of plates abuts on a circumference of the coil between the pair of flanges. In short, the pair of plates, which extends from the flange on one side to the flange on the other side, is mounted on the coil. Therefore, the circumference of the coil is defined into two regions (outer peripheries) by the pair of plates. Then, one of the outer peripheries out of the two regions defined as above is covered by the resin cover. The pair of plates may be made of a resin that is softer than the metallic coil.

As stated above, the resin cover may be made by injection molding. The pair of plates is mounted on the flanges of the bobbin and abuts on the circumference of the coil before injection molding of the resin cover is performed. This way, the pair of plates becomes a boundary between a region covered by the resin cover and an exposed region of the circumference of the coil. Therefore, when injection molding of the resin cover is performed, a molten resin is filled onto one of the outer peripheries of the coil to the plates that serve as boundaries. On the contrary, the other outer periphery of the coil remains exposed. In short, the pair of plates defines a part of the cavity inside the die for the injection molding. Details are explained below. When the injection molding is performed, the resin-made plates are located between a cavity surface of the die and the circumference of the coil, and back surfaces of the plates (surfaces on opposite sides of surfaces that face the circumference of the coil) abut on the cavity surface of the die. As stated above, as the back surfaces of the plates and the cavity surface of the die abut on each other, abutment surfaces of the plates (surfaces that face the circumference of the coil) are adhered to the circumference of the metallic coil without a gap. Therefore, the pair of plates is able to prevent a molten resin injected onto one of the outer peripheries of the coil inside the cavity from flowing out onto the other outer periphery of the coil.

Further, according to the above aspect, a bobbin abutment surface of each of the plates, and a plate material-abutment surface of the bobbin may be formed into a wave shape. The bobbin-abutment surface of each of the plates is a surface of each of the pair of plates, which abuts on the bobbin. The plate material-abutment surface of the bobbin is a surface of the bobbin, which abuts on the plate material. Further, each of the pair of plates and the bobbin may abut on each other through wavy surfaces. According to this structure, when the injection molding is performed, the plates and the bobbin abut on each other so as to mesh with each other through wavy surfaces. Thus, the molten resin does not leak out from between the plates and the bobbin. In short, the plates are adhered to the circumference of the coil, and the plates and the flanges of the bobbin abut on each other through the wavy surfaces. A gap is not made between one of the flanges and the other flange of the bobbin, on which the plates are mounted. The gap means a gap by which the injected molten resin leaks out onto the circumference of the coil having an exposed part. As stated above, an exposed region of the coil is ensured appropriately.

The reactor according to the above aspect may be manufactured by the following manufacturing method. In this method, inside the die for the injection molding, the back surface of each of the pair of plates abuts on the cavity surface of the die, and each of the plates defines the cavity for forming the resin cover. The back surfaces are the surfaces of the pair of plates on the opposite sides of the surfaces of the pair of plates, which abut on the coil. Prior to forming of the resin cover, the coil is wound around an outer part of a straight part of the O-shaped magnetic core through the bobbin. Then, an assembly, in which the pair of plates is mounted on the flanges of the bobbin, is inserted into the cavity of the die. The above method is called insert injection molding, which is a resin injection molding method. After the assembly is inserted, the die is clamped. When clamping the die, parts of the die slide to the coil side and press the plates onto the coil. The parts of the die are slide dies. Due to the pressing, the plates of the assembly inserted into the die abut on the cavity surface of the die and the circumference of the coil. This way, the plates define the cavity for forming the resin cover. Thereafter, a molten resin is injected into one of defined cavity spaces, thereby forming the resin cover on the circumference of the coil. A space for the molten resin to flow is provided between parts of the plates other than parts that are pressed by the slide dies, and the cavity surface. When the molten resin is injected into the cavity, the plates are pressed to the coil side due to pressure of the molten resin (herein after, referred to as molten resin pressure) inside the space. Similarly, a space for the molten resin to flow is also provided between the coil and the bobbin or the core, and the coil is pressed to the plate material sides. Therefore, in the forming method for the reactor according to the foregoing aspect, when the reactor is formed as the molten resin is poured into the die by resin injection molding, it is ensured that the plates of the inserted assembly define the cavity surface. The plates are pressed to the coil side by the slide dies and the molten resin pressure. The coil is pressed to the plate material sides by the molten resin pressure, and the molten resin does not leak out from between the plates and the coil. Therefore, the exposed region of the circumference of the coil is ensured appropriately.

Details and further improvements of the foregoing aspect are explained in BRIEF DESCRIPTION OF THE DRAWINGS below.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
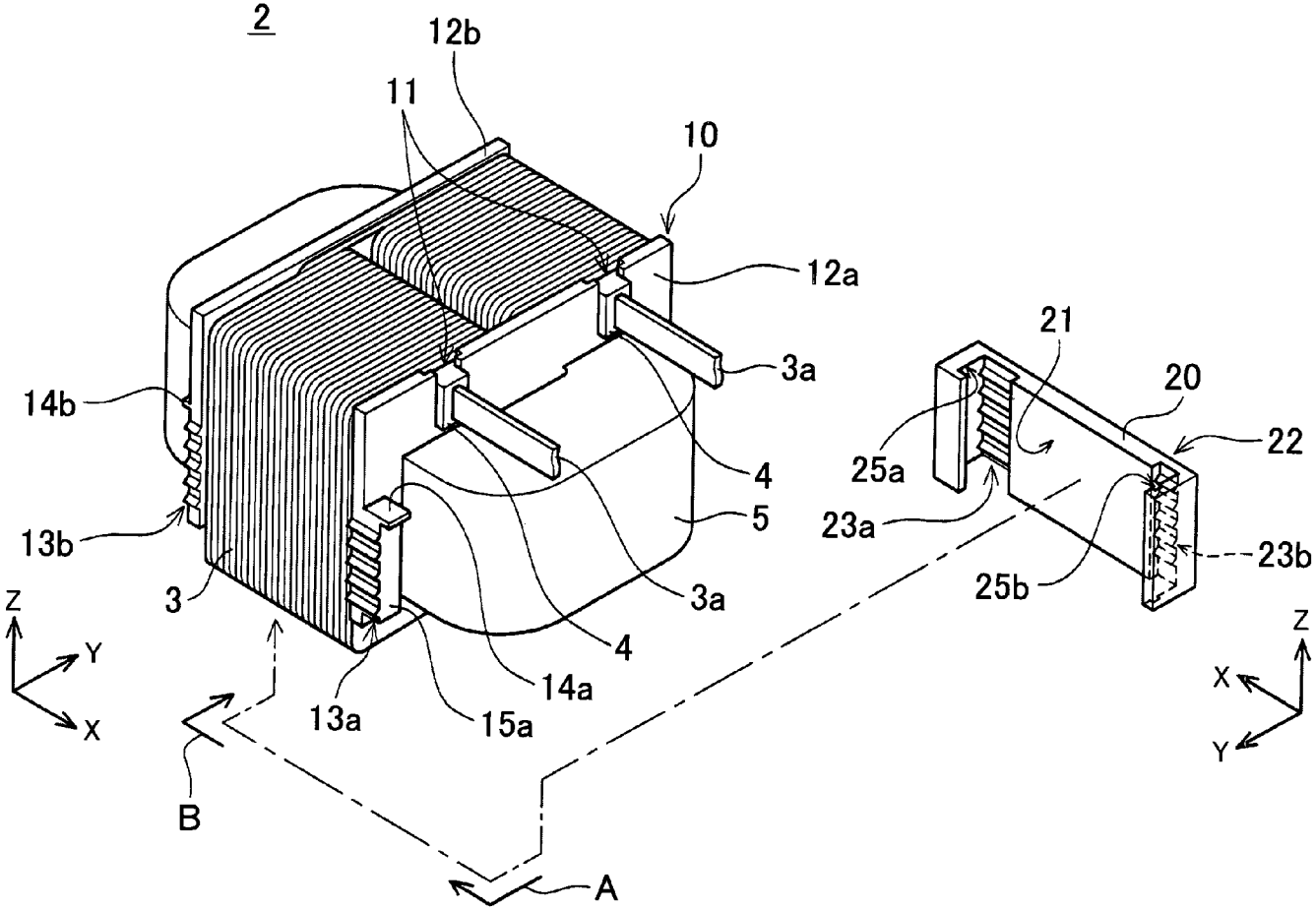
FIG. 1 is a perspective view of a reactor according to an example (before a resin cover is formed. A plate material is disassembled)
Figure 2:
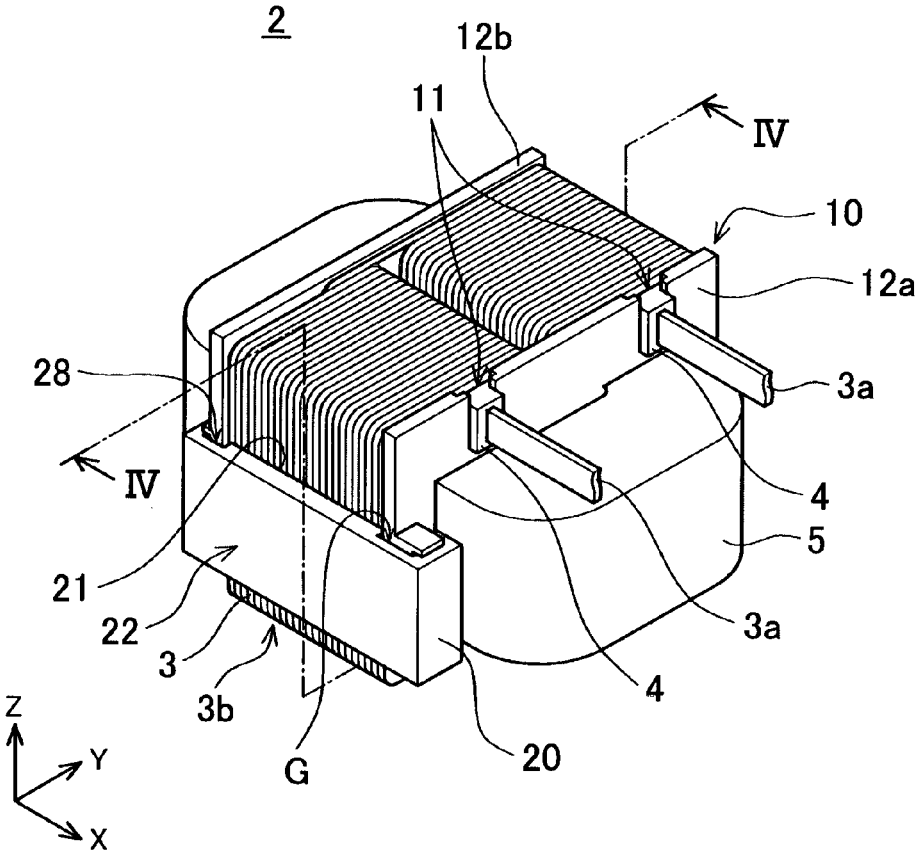
FIG. 2 is a perspective view of a reactor on which the plate material is mounted (before the resin cover is formed)

A reactor according to an example is explained with reference to the drawings. FIG. 1 and FIG. 2 show a reactor 2 before a resin cover is formed. FIG. 1 shows a state where a plate material 20 is removed, and FIG. 2 shows a state where the plate material 20 is mounted.

The reactor 2 is used for a converter. For example, the converter is used for an electric vehicle, and the converter boosts battery voltage to an electric voltage adequate for motor drive. Such a reactor 2 is used for large current having allowable current of 100 [A] or above, and, a rectangular wire is used as a winding wire of a coil. The rectangular wire is a conductive wire having a rectangular section, and has small electric resistance. In the reactor 2, the rectangular wire is wound so that a wide surface of the rectangular wire is oriented in a longitudinal direction of the coil. In other words, the rectangular wire is wound so that a narrow surface of the rectangular wire is oriented in a radial direction of the coil. Such a way of winding is referred to as edgewise or longitudinal winding. In the edgewise winding, the rectangular wire is wound so that the wide surface of the rectangular wire is oriented in the longitudinal direction of the coil. Therefore, in the edgewise winding, it is difficult to align each winding at high accuracy. Hence, in the edgewise winding, accuracy in a circumferential direction of the coil is not high.

A structure of the reactor 2 is explained. The reactor 2 includes a circular core 5 (an O-shaped core) made of a magnetic body, a bobbin 10, coils 3, and a pair of plates 20. Parts of the circular core 5 are parallel to each other. Each of the parallel regions of the circular core 5 is covered by the resin-made bobbin 10. The coils 3 are structured by two coils that are electrically connected to each other in series. Each of the two coils is wound around the bobbin 10 at the parallel regions of the circular core 5. Flanges 12*a*, 12*b* are provided on both sides of the bobbin 10 in an axis direction of the coil. The flanges 12*a*, 12*b* restrict both ends of the coils 3. Slits 11 are provided in the flange 12*a*, which is one of the flanges 12*a*, 12*b*. Small resin pieces 4 are fitted to the slits 11 provided in the flange 12*a*. Through holes are formed in the small resin pieces 4. Lead parts 3*a* of the coils pass through the through holes. The reactor 2 is electrically connected with other device at distal ends of the lead parts 3*a* of the coils.

FIG. 1 depicts that one of the pair of plates 20 is removed from the bobbin 10. Therefore, in FIG. 1, the other one of the pair of plates 20 is hidden behind the bobbin 10 and the coils 3 and thus not seen.

Coordinate systems of the drawing are explained. A direction in which an axis of the coil extends corresponds to a direction in which an X axis extends. In FIG. 1, a point of view is different on the left side (drawings of the coils 3 and the bobbin 10) and the right side of the drawing (the drawing of the plate material 20) (see the two coordinate systems in the drawing). The plate material 20 is rotated as shown by arrows A and B and assembled to the bobbin 10.

Next, the plate material 20 is explained. The pair of plates 20 is mounted on the bobbin 10 so that the plates face each other while sandwiching the double coils 3. One of the plates 20, which is depicted in FIG. 1 is explained. The other plate material has a similar structure.

The plate material 20 is bridged between the pair of flanges 12*a*, 12*b* of the bobbin 10. In other words, the plate material 20 extends from the flange 12*a* on one side to the flange 12*b* on the other side. The plate material 20 includes vertical grooves 25*a*, 25*b* on both ends along the longitudinal direction of the coil. The vertical grooves 25*a*, 25*b* are fitted to protrusions provided in the flanges of the bobbin 10. In FIG. 1, the protrusion 15*a* provided on an outer side of the flange 12*a* is depicted. On the other hand, the protrusion provided on an outer side of the other flange 12*b* is located on a back side of the flange 12*b*. Therefore, in FIG. 1, the protrusion provided in the flafige 12*b* is not seen. The protrusion 15*a* on one side fits to the vertical groove 25*a* on one side of the plate material 20. The vertical groove 25*b* on the other side of the plate material 20 is fitted to the protrusion provided on the outer side of the flange 12*b*. In short, as shown by an alternate long and short dash line in FIG. 1, the plate material 20 matches an extending direction of the protrusion 15*a* on one side and an extending direction of the vertical groove 25*a*. Similarly, the plate material 20 matches an extending direction of the other protrusion and an extending direction of the vertical groove 25*b*. Then, the plate material 20 is fitted from beneath the bobbin 10. In short, the plate material 20 is fitted from a negative direction to a positive direction of a Z axis in the coordinate system on the left side of FIG. 1. FIG. 2 shows a state where the plate material 20 is fitted. A stopper 14*a* is provided in an upper part of the protrusion 15*a*. As the protrusion 15*a* is aligned with the vertical groove 25*a* and the plate material 20 slides upwards, an upper surface of an end part of the plate material 20 abuts on the stopper 14*a*. Once the plate material 20 abuts on the stopper 14*a*, the plate material 20 is no longer able to slide. A stopper 14*b* is also provided in the other flange 12*b* of the bobbin 10. As the vertical groove 25*b* is aligned with the protrusion located on the back side of the flange 12*b* in the drawing and the plate material 20 slides upwards, an upper surface of the other end part of the plate material 20 abuts on the stopper 14*b*. As the plate material 20 abuts on the stopper, a position of the plate material 20 is decided.

Both ends of the plate material 20 are caught by the bobbin 10. An engagement surface 23*a* is provided on one end side of the plate material 20. A surface of the engagement surface 23*a* is formed into a wave shape (herein after, also referred to as a "wavy surface"). A bobbin-side engagement surface 13*a* of the bobbin 10 is also formed into a wave shape. The bobbin-side engagement surface 13*a* faces the engagement surface 23*a*. Similarly, an engagement surface 23*b* having a wave-shaped surface is also provided in the other end of the plate material 20. A bobbin-side engagement surface 13*b* is also formed into a wave shape. The bobbin-side engagement surface 13*b* faces the engagement surface 23*b*. The bobbin-side engagement surface 13*b* corresponds to an end surface of the flange 12*b*. As the vertical grooves 25*a*, 25*b* of the plate material 20 are aligned with the protrusions of the bobbin, and the plate material 20 slides, the wave-shaped engagement surface 23*a* and the wave-shaped bobbin-side engagement surface 13*a* face each other, and the engagement surface 23*b* and the bobbin-side engagement surface 13*b* face each other. The bobbin 10 and the plate material 20 are both resin-made members. Therefore, the plate material 20 is able to slide upwards (in the positive direction of the Z axis) while, tops of the wave surfaces rub each other. Once the plate material 20 abuts on the stoppers 14*a*, 14*b*, the wavy surfaces of the plate material 20 and the bobbin 10 are engaged with each other. Then, the plate material 20 is caught by the bobbin 10. In short, the engagement surface 23*a* (23*b*) of the plate material 20 and the bobbin-side engagement surface 13*a* (13*b*) are formed into wave shapes, and face each other. The engagement surface 23*a* (23*b*) of the plate material 20 and the bobbin-side engagement surface 13*a* (13*b*) are engaged with each other as peaks of the wavy surfaces come into contact with each other.

Figure 3:
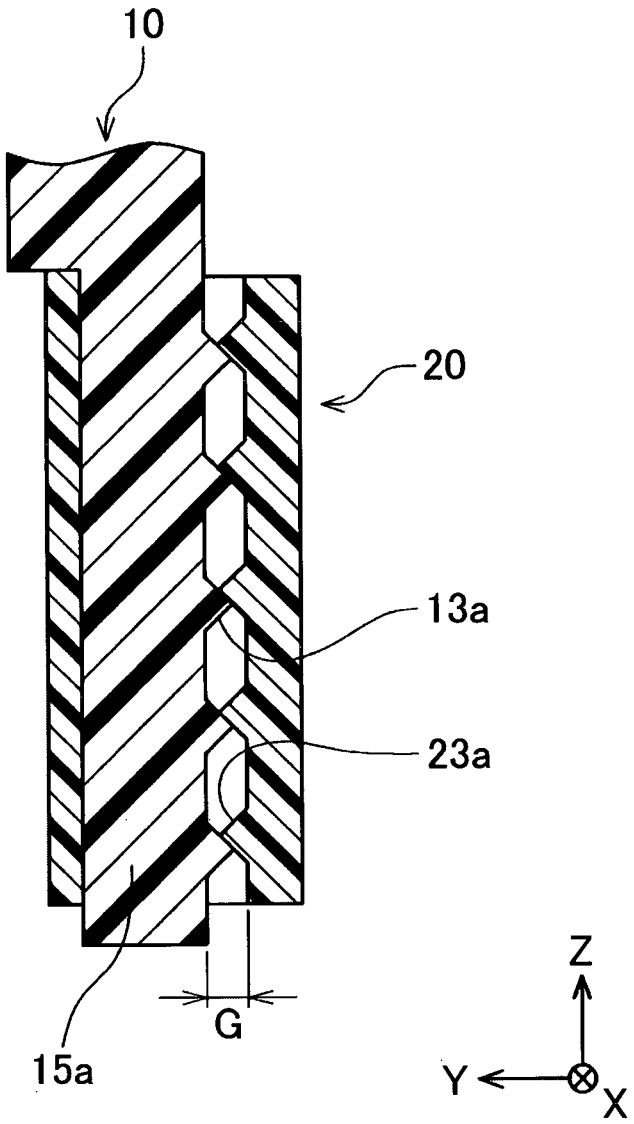
FIG. 3 is an enlarged sectional view of a fitting region between the plate material and a bobbin.

FIG. 3 shows a sectional view of an engagement area of the plate material 20 and the bobbin 10 (the protrusion 15*a*). As shown in FIG. 3, there is an interval of a gap G between a bottom of the engagement surface 23*a* of the plate material 20 and a bottom of the bobbin-side engagement surface 13*a*. However, the top of the engagement surface 23*a* and the top of the bobbin-side engagement surface 13*a* abut on each other and are engaged with each other. As shown in FIG. 3, the plate material 20 and the bobbin 10 abut on each other thorough the wavy surfaces. The gap G is also shown in FIG. 2.

As shown in FIG. 1 and FIG. 2, the plate material 20 abuts on circumferences of the coils 3 between the pair of flanges 12*a*, 12*b* of the bobbin 10. A surface of the plate material 20 on the side that abuts on the circumference of the coil 3 is referred to as an abutment surface 21, and a surface on the opposite side is referred to as a back surface 22. The pair of plates 20 abuts on the circumferences of the coils 3 while facing each other. Therefore, in a section that goes across the coil, the pair of plates 20 divides an outer periphery of the coils into two. Although explained later, the outer periphery of the coils on an upper side of the plate material 20 (in the positive direction in the Z axis) is covered by a resin cover. On the other hand, the outer periphery of the coils on a lower side of the plate material 20 (in the negative direction in the Z axis), in short, coil bottom surfaces 3*b*, is exposed form the resin cover. The resin cover is made by injection molding. Next, the resin cover is explained.

Figure 4:
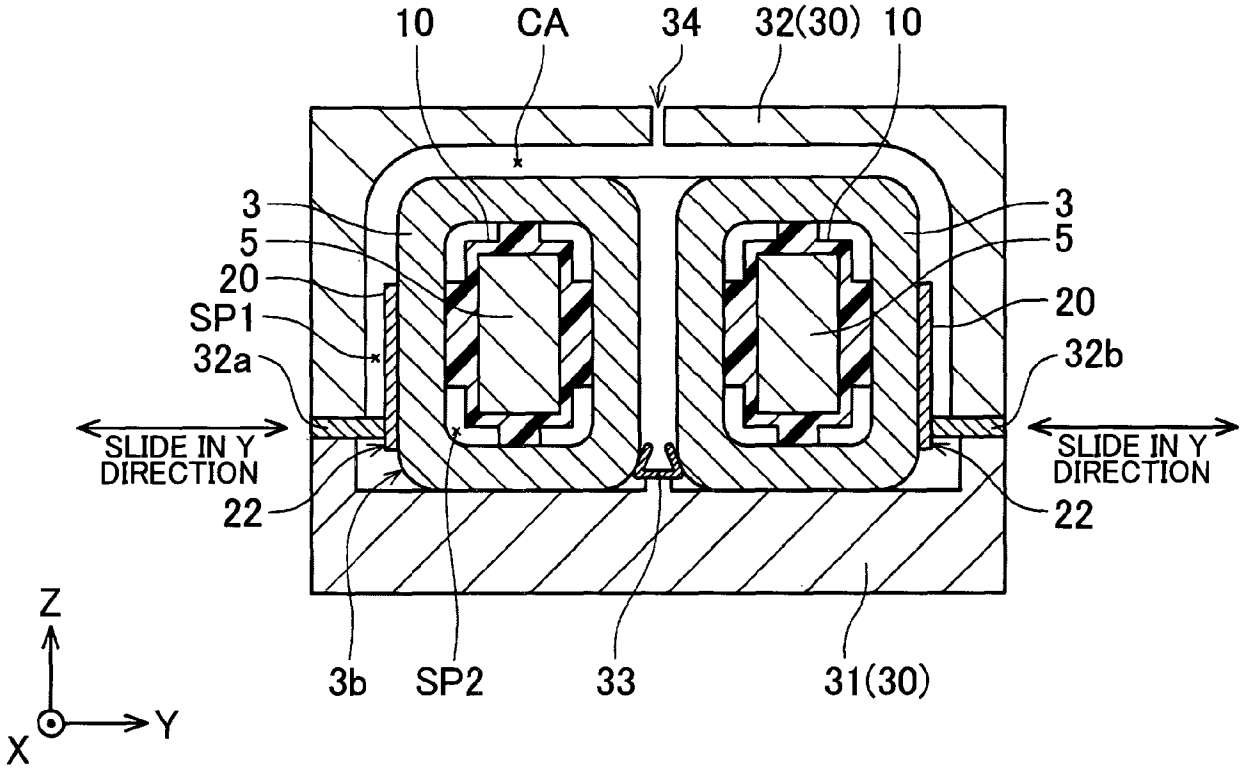
FIG. 4 is a sectional view taken along the line IV-IV in FIG. 2 (a sectional view in a state where an assembly of a coil and the bobbin is put in a die)

FIG. 4 shows a sectional view taken along the line IV-IV in FIG. 2. FIG. 4 is a sectional view of a state where an assembly of the coils 3, the bobbin 10, the core 5, and the plates 20 are set in the die 30. In other words, the sectional view in FIG. 4 corresponds to a section that intersects with the axis of the coil. In FIG. 4, the reference numeral 5 denotes the core, and the reference numeral 10 denotes the bobbin (a cylinder part around which the coil is wound).

The assembly of the coil and so on is placed on a lower die 31, and covered by an upper die 32 from the top. Parts on sides of a cavity surface of the upper die 32 are slide dies 32*a*, 32*b*. The slide dies 32*a*, 32*b* slide in a Y axis direction and abut on the back surfaces 22 of the plates 20. As the slide dies 32*a*, 32*b* abut on the back surfaces 22 of the plates 20, the plates 20 are pressed against the circumferences of the coils 3. When the slide dies 32*a*, 32*b* abut on the back surfaces 22 of the plates 20, a space SP1 is made between the back surfaces 22 of the plates 20 and the cavity surface of the upper die 32. When a molten resin is poured into a cavity CA, the molten resin flows into the space SP1, and the back surfaces 22 of the plates 20 are pressed by pressure of the molten resin. As the back surfaces 22 are pressed as stated above, the plates 20 are pressed against the circumferences of the coils 3. There is a space SP2 between the coils 3 and the bobbin 10 (or the core 5), into which the molten resin flows. When the molten resin is flown into the cavity CA, the coils 3 is pressed against the plates 20 by pressure of the molten resin. As stated above, in the coils 3, the rectangular wire is wound edgewise, and surface accuracy of the circumferences of the coils 3 is not high. The plates 20 are made of a resin, the plates 20 are pressed to the coils 3 side by the slide dies 32*a*, 32*b* and the pressure of the molten resin, and the coils 3 are pressed to the plate material 20 sides by the pressure of the molten resin. Therefore, the abutment surface 21 of the soft resin-made plate material 20 is deformed in accordance with the shape of the circumference of the hard metallic coil, and adhered to the circumference of the coil. Therefore, the molten resin does not leak out from between the plates 20 and the coils 3.

A columnar member 33 is provided between the double coils 3. The columnar member 33 extends in the axis direction of the coil. The columnar member 33 abuts on the circumference of each of the double coils and seals a space between the coils 3. As shown in FIG. 4, the pair of plates 20 that abuts on the opposing circumferences of the coils 3, respectively, divides a region of the circumferences of the coils into two. In FIG. 4, the two regions are the outer periphery of the coils on the upper side of the plates 20 and the outer periphery of the coils on the lower side of the plates 20.

The outer periphery on the upper side faces the cavity CA. Parts of the plates 20 (regions of the back surfaces 22 facing the upper die 32 and abutting on the slide dies 32*a*, 32*b*) define a part of the cavity CA. In short, the cavity surface of the upper die 32, the pair of plates 20, and the columnar member 33 define the cavity CA. A gate 34 in FIG. 4 is a gate in which the molten resin is poured. The molten resin flown from the gate 34 spreads into the cavity CA. The molten resin is held back by the plates 20 that are adhered to the circumferences of the coils 3 on the sides of the coils 3. Therefore, the molten resin does not leak out on the outer periphery of the coils 3 on the lower side (in short, the bottom surface 3*b* sides of the coils). As explained by using FIG. 3, since the bobbin 10 and the plates 20 abut on each other through the wavy surfaces, the molten resin does not leak from between the bobbin 10 and the plates 20. This way, during injection molding, the molten resin does not leak out to side of the coil bottom surfaces 3*b* to be exposed, thereby ensuring an exposed region of the coils.

Between the double coils 3, the resin-made columnar member 33 is adhered to the circumferences of both of the coils, thereby preventing leakage of the molten resin.

Figure 5:
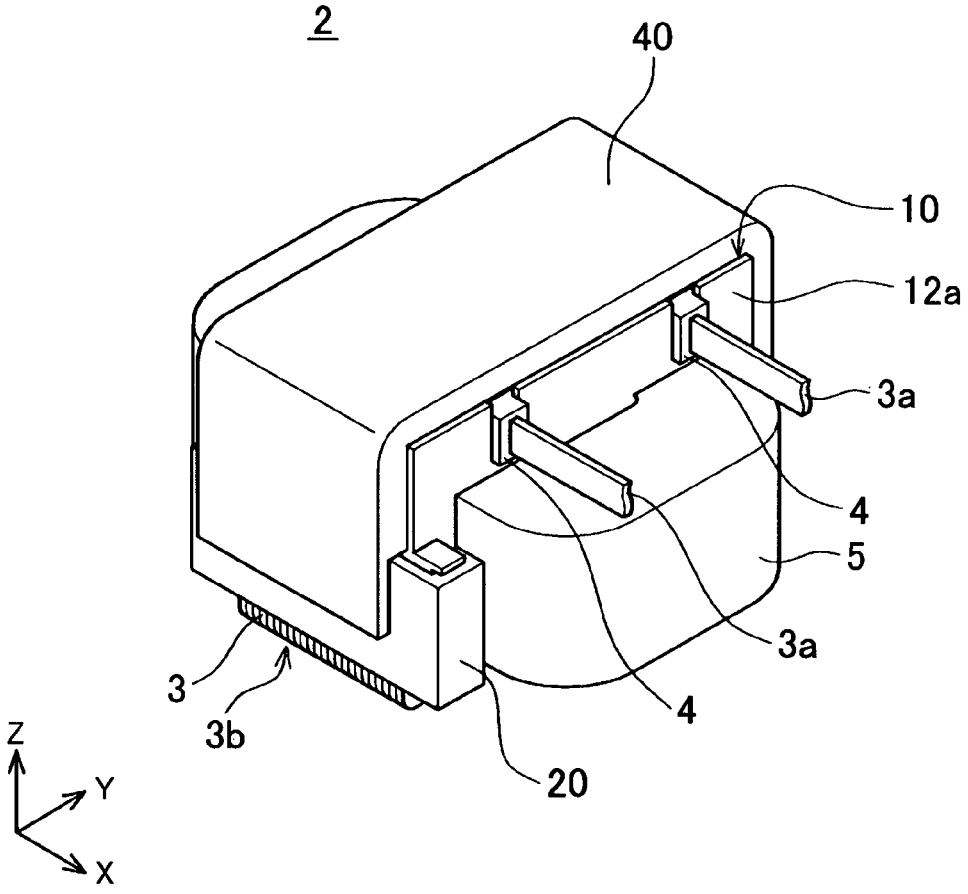
FIG. 5 is a perspective view of a completed reactor.

FIG. 5 shows a perspective view of the reactor 2 as a complete product in which a resin cover 40 is formed. The resin cover 40 covers the coils 3 between the pair of flanges 12*a*, 12*b* of the bobbin 10, but exposes the bottom surfaces 3*b* of the coils 3. As shown in FIG. 5, the plates 20, the flange 12*a*, and the resin cover 40 integrally cover the coils 3. This way, the reactor 2 that ensures exposure of the coil bottom surfaces 3*b* is completed.

In the reactor in FIG. 5, the core 5 projecting from end parts of the bobbin 10 is exposed. The core 5 may be covered by a resin.

Next, notes with regard to the example are stated. The reactor 2 of the example includes the circular core 5 and the double coils 3. However, the shapes of the core and the coil are not limited to the above. The example may be applied to a reactor that includes a linear rod-like core, and a single coil that is wound around the core.

The plates 20 are combined with and caught by the bobbin 10 while sliding. A form of engagement between the plates and the bobbin is not limited to the above-mentioned sliding method. The plates 20 may be fixed to the bobbin 10 by using other engagement metal fitting such as a screw and a clip. Alternatively, projections may be provided in the plates 20 and holes may be provided in the bobbin 10 for receiving the projections. Then, the plates may be fixed by press fitting the projections into the holes. In any case, it is only necessary that opposing surfaces of the plates and the bobbin (the flanges) are formed into a wave shape, and peaks of the wave come into contact with each other.

The coils are cylinder-shaped, and "circumferences of the coils" mean surfaces of the cylinders except end surfaces in the axis direction of the cylinders. The "outer peripheries of the coils defined by the pair of plates" mean the circumferences of the two coils that are sectioned by a straight line connecting the pair of plates in a section orthogonal to the axis of the coils. In a case where a plurality of coils are arranged in line so that that axes of the coils are in parallel with each other, an outline that entirely contain the plurality of coils is regarded as a single virtual coil in a section orthogonal to the axes of the coils. In the case where the plurality of coils are arranged in line so that the axes of the coils are in parallel with each other, the "circumferences" and the "outer peripheries of the coils defined by the pair of plates" are assumed with respect to the single virtual coil. Typically, in the case where the two coils are arranged in line as shown in FIG. 4, the outline that contains the two coils is regarded as a single coil in the section in FIG. 4. The pair of plates 20 abuts on the circumference of the virtual coil, which is regarded as the single coil.

Moreover, the resin cover covers one of the two outer peripheries of the coils, which are defined by the pair of plates. However, the resin cover is not limited to a form of entirely covering one of the outer peripheries. For example, the resin cover may cover one of the two outer peripheries of the coils, and may also have a small window from which a part of the circumference of the coil is exposed in one of the outer peripheries of the coils. A typical example of the small window is a screw hole, or a small window for cooling a part of the circumference of the coils in order to promote cooling of the coils.

The reactor explained in the example may be expressed as follows from a different point of view. The reactor includes the bobbin, the coils, the pair of plates, and the resin cover. The bobbin has the pair of flanges facing each other. The coils are wound about the bobbin between the pair of flanges. Each of the pair of plates is bridged from the flange on one side to the flange on the other side, and abuts on the circumference of the coil between the flanges. The resin cover covers at least a part of the coils. The resin cover exposes one of the two outer peripheries of the coils, which are defined by the pair of plates. When the resin cover is viewed in a direction perpendicular to the plates, with respect to each of the plates, the plates define a boundary of the resin cover.

Further, "the circumferences of the coils" may be also put as "side surfaces of the cylindrical coils except end surfaces of the coils". The "two outer peripheries of the coils, which are defined by the pair of plates" may be simply referred to as a first outer periphery region and a second outer periphery region (or a first side surface region and a second side surface region). For example, in the reactor 2 of this example, the region on the upper side of the plate material 20 corresponds to the first outer periphery region, and the region on the lower side of the plate material 20 corresponds to the second outer periphery region. In the complete reactor 2, the first outer periphery region is covered by the resin cover 40, and the second outer periphery region is exposed.

The core of the reactor is not limited to an O-shaped core. For example, a structure of the core may be such that a gap is formed between a pair of U-shaped cores.

In the reactor of this example, the coil is used, in which the rectangular wire is wound edgewise. The example is not limited to the reactor having an edgewise winding coil. For example, the example may also be applied to a reactor having a coil in which a rectangular wire is wound flatwise. The flatwise winding means that the rectangular wire is wound so that a wide surface of the rectangular wire is oriented in a radial direction of the coil. Further, this example may be applied to a reactor having coil in which a regular wire having a circular section, instead of the rectangular wire, is wound.

Specific examples of the invention has been explained in detail, but are examples only, and do not limit the scope of the claims. The technology stated in the scope of the claims includes various modifications and changes of the specific examples stated above. The technical elements explained in this specification and the drawings achieve technical utility alone or as various combinations, and are not limited to the combinations described in the claims on filing. Moreover, the technology described as an example in the specification and the drawings is able to achieve a plurality of objectives simultaneously. The technology described as an example in the specification and the drawings has technical utility by achieving one of the objectives.

The invention claimed is:

1. A reactor comprising:

a resin-made bobbin having a pair of flanges that face each other;

a coil wound around the bobbin between the pair of flanges;

a pair of plates mounted on the bobbin so that the pair of plates face each other with the bobbin disposed between the pair of plates, wherein the pair of plates extend from one of the pair of flanges to the other of the pair of flanges and the pair of plates abuts on a circumferential surface of the coil between the pair of flanges so that a first outer periphery region of the circumferential surface of the coil is provided above the pair of plates and a second outer periphery region of the circumferential surface of the coil is provided below the pair of plates; and a resin cover that covers only one of first and second outer periphery regions of the coil.

2. The reactor according to claim 1, wherein each of the pair of plates and the bobbin abut on each other through a wavy surface.

3. The reactor according to claim 1, wherein the resin cover is formed by injection molding.

4. A manufacturing method for the reactor according to claim 3, wherein, inside a die for injection molding, a back surface of each of the pair of plates abuts on a cavity surface of the die, and each of the pair of plates defines the cavity for forming the resin cover, the back surface being a surface of each of the pair of plates on an opposite side of a surface that abut on the coil.

5. The reactor according to claim 1, wherein the first outer periphery region is a region on an upper side of the pair of plates, and the second outer periphery region is a region on a lower side of the pair of plates.

* * * * *